United States Patent [19]

Fratturo

[11] 4,168,809

[45] Sep. 25, 1979

[54] TEXTILE SPINDLE AND YARN SUPPORT TUBE CONSTRUCTION

[75] Inventor: Jules P. Fratturo, Greenville, S.C.

[73] Assignee: Textube Corporation, Greer, S.C.

[21] Appl. No.: 831,153

[22] Filed: Sep. 7, 1977

[51] Int. Cl.[2] ..... B65H 54/54; B65H 54/74; B65H 75/18

[52] U.S. Cl. ..... 242/46.21; 242/46.6

[58] Field of Search ..... 242/46.21, 46.2, 46.3, 242/46.4, 46.5, 46.6; 57/129, 130

[56] References Cited

U.S. PATENT DOCUMENTS

| | | | |
|---|---|---|---|
| 768,727 | 8/1904 | Belanger | 242/46.21 |
| 2,536,618 | 1/1951 | Wood | 57/130 |
| 2,625,336 | 1/1953 | Brouillard | 242/46.6 |
| 2,639,576 | 5/1953 | Bay | 242/46.6 X |
| 3,167,262 | 1/1965 | Adams et al. | 242/46.21 |
| 3,306,543 | 2/1967 | Beerli | 242/46.6 |
| 3,327,466 | 6/1967 | Hare | 242/46.2 X |
| 3,534,917 | 10/1970 | Blake | 242/46.21 |
| 3,544,026 | 12/1970 | Bowie et al. | 242/46.6 |
| 3,695,531 | 10/1972 | Whitehead | 242/46.21 |
| 3,878,997 | 4/1975 | Adams et al. | 242/46.21 |

FOREIGN PATENT DOCUMENTS

| | | | |
|---|---|---|---|
| 1092219 | 11/1954 | France | 242/46.6 |

*Primary Examiner*—Stanley N. Gilreath

*Attorney, Agent, or Firm*—Wellington M. Manning, Jr.; Luke J. Wilburn, Jr.

[57] ABSTRACT

An improved textile spindle and yarn support tube construction for use in textile winding machines, in particular, those having a reciprocating rail, ring and traveler type winding mechanism. The spindle comprises a base portion having a conventional whorl and mounting pin, and an upper, yarn tube-receiving shaft portion of generally circular cross-sectional configuration. The upper portion of the spindle shaft is provided with radially outwardly biased elements which engage the internal passageway of the yarn tube when seated thereon to provide driving connection of the tube to the spindle. The yarn supporting tube is of elongate shape having an internal longitudinal passageway therethrough. The upper portion of the passageway is provided with an inward protrusion which serves to abut the upper end of the spindle during placement of the tube thereon to positively stop downward movement of the tube on the spindle and thereby provide uniform vertical alignment of tubes on the spindles during the winding operation.

3 Claims, 3 Drawing Figures

TEXTILE SPINDLE AND YARN SUPPORT TUBE CONSTRUCTION

The present invention is directed to improvements in textile yarn handling apparatus and, more particularly, to an improved textile spindle and yarn support tube construction which ensures uniform positioning of yarn-receiving support tubes on rotating spindles of a textile winding machine for forming textile yarn packages.

In conventional textile winding machines of the ring-traverse type having a row of rotatably driven spindles for supportably receiving and rotating yarn-receiving tubes during a yarn package-forming operation, it is desirable that the tubes be easily and quickly placed on and removed from the rotating spindles to facilitate and expedite yarn package doffing and tube donning operations. Also, to ensure proper yarn package build on the support tubes during winding, the tubes must be accurately centered on the spindles, and uniformly vertically aligned from spindle to spindle, so that the vertically reciprocating yarn guide mechanism of the machine, i.e., the ring-traverse rail, places the yarn in the proper location on each tube. If the tubes are not uniformly vertically aligned during winding, improper yarn package build-up occurs, with resultant problems in package unwinding operations. It is also essential for proper package build that the yarn tubes be positively engaged and driven by the spindles to ensure uniform rotation of the tubes during winding.

In such ring-traverse type yarn winding machines, it has been one practice to employ spindles having tube-receiving shafts of generally uniform, circular cross-sectional diameter, and yarn support tubes therefor having an upwardly tapered internal passageway so that when each tube is pushed down onto the spindle shaft, the wall of the passageway is slidably frictionally engaged at its upper end portion by the upper end of the spindle shaft to create a driving connection between spindle and tube.

In such spindle and tube constructions, problems are experienced in maintaining a uniform "tube line", i.e., uniform vertical alignment of the tubes on the spindles and with the reciprocating yarn guide rail which directs the yarns onto the tubes. Also, problems occur in removing the yarn package and tube from the spindle during doffing operations. Because such yarn support tubes are generally constructed of thin, light weight plastic or paper, inwardly directed pressure of the yarn on the outer surfaces of a tube during winding often causes the tube to deform and bind on the spindle at its points of frictional engagement, thus making it difficult to quickly and easily remove the yarn package during doffing. Because such plastic and paper tubes also tend to wear at their points of sliding frictional engagement with the spindles, they become frictionally seated at lower positions on the spindles with repeated use. As a result, during a winding operation, the reciprocating yarn guide mechanism, i.e., the reciprocating traverse-ring support rail, improperly locates the yarn on these worn tubes, causing improper package build-up and resultant problems in unwinding of the yarn.

It has further been known in yarn winding machines to provide tube support spindles having a lower radial flange, or shoulder, which engages and supports the bottom edge of the tube during winding to facilitate vertical alignment of the tubes on the spindles. Such spindles have been further provided, at their upper end portions, with outwardly spring-biased elements which engage the inner surface portions of the tube to provide frictional driving connection of tube to spindle. However, in such spindle constructions, it can be appreciated that variations in the length of the tube or tube wear at its lower end caused by engagement with the support flange of the spindle will result in improper vertical alignment of the tube on the spindle and improper package build-up.

It is therefore an object of the present invention to provide an improved yarn tube and drive spindle construction for textile winding machines of the type described which facilitates the ease and speed of placement and removal to the tubes from the spindles during donning and doffing operations, and further ensures proper vertical alignment of the tubes and positive driving engagement of tubes and spindles during yarn-winding and package-forming operations.

In its broad aspects, the present invention comprises an elongate yarn support tube of relatively thin-wall construction having an outer yarn-receiving surface and a longitudinal passageway therethrough for reception of a driving spindle. The internal wall of the tube passageway is dimensioned such that the major portion of the tube wall is located on the driving spindle in spaced relation from the spindle surface, and the upper portion of the tube passageway is provided with an inwardly protruding surface portion which abuts the upper end of the spindle to positively stop downward movement of the tube onto the spindle during donning, thus accurately vertically positioning the tube on the spindle during the winding operation.

Correspondingly, the tube-supporting shaft of the spindle is of generally uniform circular cross-section throughout its major length, and the upper end portion of the spindle is provided with outwardly spring-biased means for frictionally engaging the inner surface of the tube to provide positive driving connection between spindle and tube during the winding operation.

The present invention will be better understood from the following detailed description of a preferred embodiment of tube and spindle construction, when taken in connection with the accompanying drawings in which.

Figure 1:
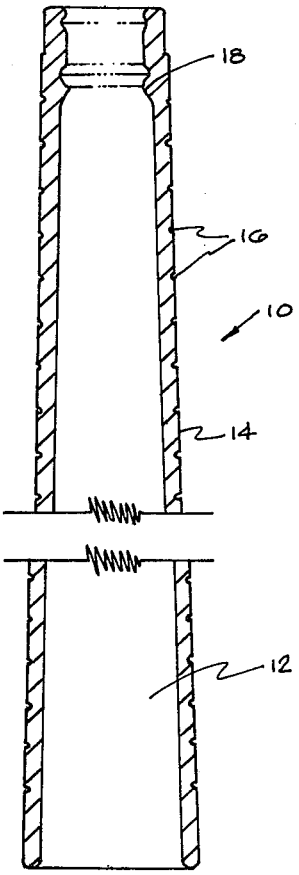
FIG. 1 is a partial, longitudinal section view of a yarn support tube according to the present invention.

Referring more particularly to the drawings, FIG. 1 shows a longitudinal section view of upper and lower portions of a yarn support tube 10 of the present invention, the center portion of the tube being omitted for convenience of illustration. Tube 10 is of relatively thin wall, elongate construction of circular cross-sectional configuration, and may be composed of plastic, paper, metal, wood or other suitable light weight material. As seen, tube 10 has a generally upwardly tapered configuration and a central longitudinal passageway 12 therethrough for reception of a tube-supporting shaft of a spindle of a textile winding machine.

The outer yarn-receiving surface of the wall 14 of the tube may be provided with suitable means, such as grooves 16, to facilitate frictional engagement of the yarn with the surface of the tube during initial winding stages of the package-forming operation.

The inner peripheral wall of passageway 12 tapers upwardly from bottom to top of the tube and the surface of the passageway walls are smooth throughout the major portion of its length. At an upper end portion of the passageway, the walls of the passageway have a radially inward protrusion 18 which serves as means to engage the upper end portion of a spindle and prevent further movement of the tube downwardly onto the spindle during donning operations, as can be seen more fully in FIG. 2.

Figure 2:
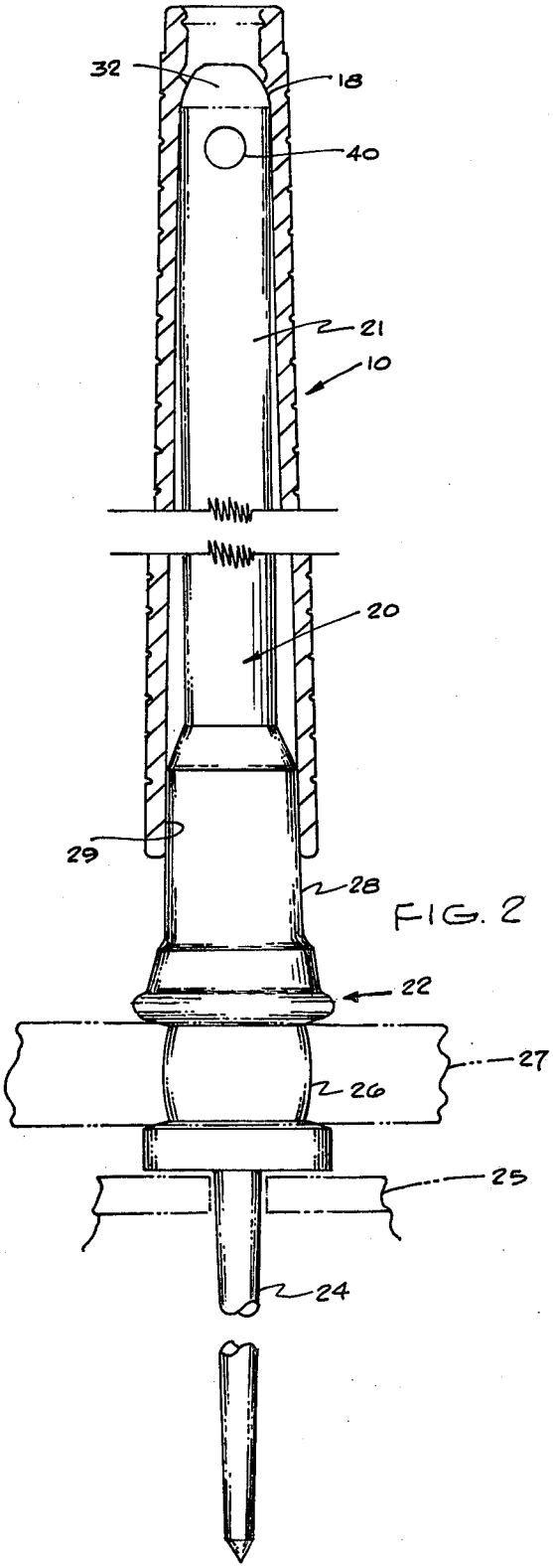
FIG. 2 is a partial, longitudinal section view of the yarn support tube of FIG. 1, shown positioned on a driving spindle of the present invention.

FIG. 2 is a partial longitudinal section view of the tube of FIG. 1 shown supportably positioned on a rotatable spindle 20 of the present invention. As in FIG. 1, the center portion of the tube and the center portion of the tube-receiving shaft 21 of spindle 20 has been omitted to facilitate illustration. Spindle 20 has a base portion 22 of generally conventional construction which includes a mounting pin 24 for supportable attachment of the spindle to the winding machine frame 25 and a whorl 26 which is engaged by the driving belt 27 of the winding machine to impart rotation to the spindle. Since the mounting of such spindles on the winding machine and their common driven engagement by drive belts of such machines are conventional and well known in the art, the winding machine is not described or shown herein in detail.

The shaft 21 of spindle 20 has an enlarged lower portion 28 for loosely engaging the lower end portion 29 of the passageway of tube 10 to facilitate guidance and alignment of the tube on the shaft 21, and an upper elongate portion of generally uniform circular cross-sectional configuration. The upper end 32 of the shaft is generally semi-spherical in shape.

As best seen in FIG. 2, when the support tube 10 of the present invention is pushed downwardly onto the shaft 21 of the spindle, it continues downwardly until its movement is positively stopped by engagement of the top of the spindle with the inward protrusion 18 in the upper portion of passageway 12. In this manner, the tube is positively stopped and located in correct vertical alignment on the spindle each time it is placed thereon, thus ensuring proper placement of the yarn on the tube by the ring traverse during the yarn winding operation. The major portion of the tube wall which receives the yarn during the winding operation is spaced from the periphery of the spindle shaft 21 so that binding of the tube on the shaft due to inward pressure of the yarn on the tube is prevented.

Figure 3:
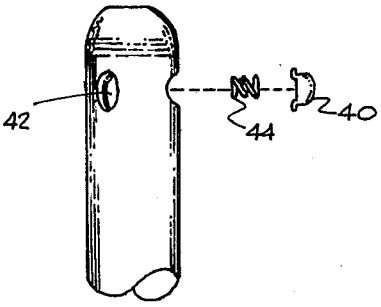
FIG. 3 is a broken-away, elevation view of the upper end portion of the spindle seen in FIG. 2.

As best seen in FIGS. 2 and 3, the upper end portion of shaft 21 of the spindle is provided with a plurality of spring-loaded buttons or elements 40 which frictionally engage the inner wall surfaces of the passageway of tube 10 when it is seated on the spindle, thus providing a driving connection between the spindle and tube during the yarn winding operation. As seen in FIG. 3, a plurality of such elements 40 are uniformally spaced about the periphery of the spindle shaft in internally grooved or undercut circular recesses 42 therein, and they are urged in radially outward direction by small springs 44 located in the recesses 42 beneath each element.

Thus, by providing positive stop means at the upper end of the passageway of the tube to abut the upper end of the spindle during the tube donning operation, the yarn support tubes can be quickly and easily located on the spindles of the textile winding machine to provide a uniform "tube line" along the machine at the winding position. By further maintaining the major portion of the tube spaced from the spindle shaft during winding, the internally directed yarn pressures on the tube do not bind the tube on the spindle shaft, thus facilitating removal of the tube and yarn package during doffing operations.

That which is claimed is:

1. An improved spindle and yarn support tube construction for use in textile winding apparatus comprising:

a spindle having a base portion including means for supportably mounting said spindle for axial rotation on a textile winding machine and for engageably receiving a driving belt of the winding machine to impart axial rotation to the spindle, an elongate shaft of generally circular transverse sectional configuration extending upwardly from said base portion and including a first radially enlarged section adjacent said base portion and a second upper elongate section of generally uniform transverse sectional configuration, and resiliently biasing means adjacent and below the upper end of said second section for frictionally engaging the wall surface of a yarn support tube to transmit rotational driving force from said spindle to the tube; and an elongate, relatively thin-walled rigid plastic yarn support tube slidingly supportably received on and surrounding said spindle shaft for rotation thereby, said tube including a lower wall portion positioned in contiguous relation about said radially enlarged portion of said spindle shaft, and a major upper wall portion located in radially spaced relation from the peripheral surface of said spindle shaft, inwardly protruding means in the upper end portion of the longitudinal passageway of the tube and abutting the upper end portion of said spindle shaft to only positively prevent further downward movement of said tube on said spindle shaft, said resiliently biasing means of said spindle frictionally engaging a wall surface portion of said tube passageway below said protruding means to transmit rotational driving force to the tube during rotation of said spindle.

2. Apparatus as defined in claim 1 wherein the inner surface of the wall of said tube is smooth throughout a major portion of the length of the tube, and wherein said inwardly protruding means in the upper portion of said tube passageway which abuts the upper end portion of said spindle shaft comprises means integral with said wall of said tube located intermediate the length of the passageway to restrict the cross-sectional diameter of the passageway.

3. Apparatus as defined in claim 2 wherein the upper end of said spindle shaft is of generally semi-spherical shape, and wherein said inwardly protruding means which abuts the upper end portion of the spindle shaft is of complementary shape to at least a portion of said end portion of said spindle shaft to provide positive abutment therewith and preclude further upward movement of the shaft through said tube passageway.

* * * * *